US011577904B2

(12) United States Patent
Wilker et al.

(10) Patent No.: US 11,577,904 B2
(45) Date of Patent: Feb. 14, 2023

(54) AIRTIGHT BAG FOR PRESERVING A FIRST SUBSTANCE AND AT LEAST ONE SECOND SUBSTANCE

(71) Applicant: KARLSSONWILKER INC., Ridgewood, NY (US)

(72) Inventors: Jan Wilker, Ridgewood, NY (US); Hjalti Karlsson, Ridgewood, NY (US)

(73) Assignee: KARLSSONWILKER INC., Ridgewood, NY (US)

( * ) Notice: Subject to any disclaimer, the term of this patent is extended or adjusted under 35 U.S.C. 154(b) by 501 days.

(21) Appl. No.: 16/345,069

(22) PCT Filed: Oct. 31, 2017

(86) PCT No.: PCT/US2017/059276
§ 371 (c)(1),
(2) Date: Apr. 25, 2019

(87) PCT Pub. No.: WO2018/085265
PCT Pub. Date: May 11, 2018

(65) Prior Publication Data

US 2019/0276219 A1 Sep. 12, 2019

Related U.S. Application Data

(60) Provisional application No. 62/415,711, filed on Nov. 1, 2016.

(51) Int. Cl.
*B65D 81/32* (2006.01)
*B65D 75/58* (2006.01)
*B65D 81/02* (2006.01)

(52) U.S. Cl.
CPC ..... *B65D 81/3272* (2013.01); *B65D 75/5816* (2013.01); *B65D 75/5883* (2013.01); *B65D 81/02* (2013.01); *B65D 2575/3227* (2013.01)

(58) Field of Classification Search
CPC ..... B65D 81/3272; B65D 75/5816; B65D 75/5883; B65D 81/02; B65D 2575/3227; B65D 81/32; B65D 75/58
(Continued)

(56) References Cited

U.S. PATENT DOCUMENTS 2,988,207 A 6/1961 Lovelace
5,482,376 A * 1/1996 Moseley ..... B65D 75/5816 383/209

(Continued)

FOREIGN PATENT DOCUMENTS

WO 2014072262 A1 5/2014

OTHER PUBLICATIONS

Bailey et al., "High Design: Creating a Marijuana Brand," Surface, retrieved from http://www.surfacemag.com/articles/high-designs/, Apr. 20, 2016, 14 Pages.

(Continued)

*Primary Examiner* — Ernesto A Grano
(74) *Attorney, Agent, or Firm* — Workman Nydegger

(57) ABSTRACT

An airtight bag is provided for preserving a first substance and at least one second substance. A first opening device is provided for providing a first opening and an access by a user to the first substance in the bag, and at least one second opening device is provided for, subsequent to accessing the first substance via said first opening, providing at least one second opening and an access by the user to the at least one second substance in the bag. The first opening device is positioned such that first opening facilitates the access by the user to the first substance. The at least one second opening device is positioned such that the at least one second opening facilitates the access by the user to the at least one second substance.

18 Claims, 6 Drawing Sheets

(58) Field of Classification Search
USPC ..... 206/260
See application file for complete search history.

(56) References Cited

U.S. PATENT DOCUMENTS

| | | | | |
|---|---|---|---|---|
| 5,593,229 | A * | 1/1997 | Warr | B65D 33/08 383/209 |
| 5,636,925 | A * | 6/1997 | Smiley | B65D 33/06 383/207 |
| 6,402,379 | B1 * | 6/2002 | Albright | B65D 75/5816 383/209 |
| 7,971,717 | B2 * | 7/2011 | Eilert | B65D 75/5816 383/906 |
| 2003/0040411 | A1 * | 2/2003 | Albright | B26F 1/22 493/194 |
| 2005/0061831 | A1 | 3/2005 | Brown et al. | |
| 2006/0094581 | A1 * | 5/2006 | Jackson | B65D 33/08 493/221 |
| 2007/0202236 | A1 * | 8/2007 | Brody | A23C 19/0908 426/582 |
| 2009/0053388 | A1 * | 2/2009 | Powers | A23L 27/70 426/650 |
| 2009/0257690 | A1 * | 10/2009 | Spenceley | B65D 75/56 383/209 |
| 2010/0296754 | A1 * | 11/2010 | Chiu | B65D 33/105 383/10 |
| 2012/0021075 | A1 | 1/2012 | Umanskaya et al. | |
| 2013/0233879 | A1 * | 9/2013 | Thimmesch | B65D 33/065 222/1 |
| 2018/0346218 | A1 * | 12/2018 | Reeves | B65D 75/5866 |
| 2019/0289864 | A1 * | 9/2019 | Swayne | A47J 36/32 |

OTHER PUBLICATIONS

International Search Report and Written Opinion from PCT Application No. PCT/US2017/059276, dated Feb. 2, 2018.

* cited by examiner

AIRTIGHT BAG FOR PRESERVING A FIRST SUBSTANCE AND AT LEAST ONE SECOND SUBSTANCE

FIELD OF THE DISCLOSURE

The present invention relates to an airtight bag for preserving a first substance and at least one second substance.

BACKGROUND OF THE DISCLOSURE

Airtight bags are used today for preserving e.g. food products such as snack, biscuits. The bags may be filled with gaseous material such as air, where the sole purpose is to prevent the food products from being crushed during transit. In some cases, the purpose of the gaseous material is to extend shell life of the food product. For example, nitrogen is often used as the gaseous material in the bag so as to reduce oxidation, which may occur more rapidly when simply atmospheric air is used within the airtight bag.

Due to this, such bags are designed for facilitating a user's access to the food products in the bag, e.g. via simple perforations or separable components at a top end of the bag allowing the user to open the bag completely via tearing off the perforations or separating the bag components. Other user friendly solutions may be used for allowing the user easily open the bag. However, the known gaseous material provided within the bags does not serve more function other than protecting the food products and reducing overall oxidation of the food products.

SUMMARY OF THE DISCLOSURE

It is an object of embodiments of the present disclosure to provide a bag that is capable of preserving more than one substances and that allows a user to access said substances in a user friendly manner.

In general, the disclosure preferably seeks to provide a first substance that serves more purpose than simply protecting the food products. In particular, it may be seen as an object of embodiments of the present disclosure to provide a bag that solves the above mentioned problems, or other problems, and to mitigate, alleviate or eliminate one or more of the above mentioned disadvantages of the prior art singly or in any combination.

To better address one or more of these concerns, in a first aspect of the disclosure an airtight bag is provided for preserving a first substance and at least one second substance, comprising:

- a first opening device for providing a first opening as a user access to the first substance in the bag,
- at least one second opening device for, subsequent to accessing the first substance via said first opening, providing at least one second opening as a user access to the at least one second substance in the bag,
- wherein the first opening device is positioned such that first opening facilitates the access by the user to the first substance, and where the at least one second opening device is positioned such that the at least one second opening facilitates the access by the user to the at least one second substance.

In one embodiment, the first substance comprises a gaseous substance adapted to be inhaled by the user via said first opening. An example of such a gaseous substance is *cannabis* smoke where via the first opening the user may easily inhale the *cannabis* smoke. However, the gaseous substances of course should not be construed as being limited to *cannabis* smoke, but *cannabis* smoke is merely given here as an example.

In one embodiment, the at least one second substance comprises a snack product and where the at least one second opening is larger that said first opening.

The first gaseous substance thus not only serves in preventing the food products from being crushed during transit by maintaining the pressure within the volume of the bag, but also serves as a consumption substance for the user. Referring to the example above where the first substance is a *cannabis* smoke, it is well known that *cannabis* causes increased hunger in the user. As such, its consumption is often accompanied by snack foods, for example, potato chips. The fact that both the first and the second substances are within the same bag, the user does not have to make an effort to go to two different locations, i.e. one where *cannabis* has been legalized and is sold, and to a different shop to buy the food product, such as the potato chips. At worst, this could create an unsafe situation if the user chooses to travel, for example, by driving or walking, while impaired. More importantly, by using all the space within the bag where both the first and the at least one second substances are adapted to be consumed by the user makes the bag more environmentally friendly due to less waste.

The first and the second substances should of course not be construed as being limited to any particular substances, but may as well be selected from, but not limited to, one or more of the following: any type of food product, any type of a liquid, any type of a medical product. As an example, the first substance could be a medical substance is gaseous form and the second substance could be water or some other liquid for flushing the mouth subsequent to the inhalation. For example, asthma medications are often in an inhaled gaseous form. But some asthma medications also leave a residue in the mouth which is not necessary to be maintained in the mouth and causes discomfort or foul taste in the mouth of the user. Thus, according to one embodiment, the first substance could be an asthma treatment medication, while the second substance could be a liquid, such as water, for rinsing the mouth.

In yet another embodiment, the first substance is a gaseous substance that includes a pleasant aroma, for example, a savory aroma or an appetite inducing aroma. Such an aroma, for example, the appetite inducing aroma, is helpful to users with a suppressed appetite, for example, users undergoing chemotherapy. According to this embodiment, the second substance is a food product, which becomes more appetizing to the user due to the appetite inducing aroma of the first substance. Such a combination thus improves the likelihood that the appetite-suppressed user will consume the food product of the second substance.

In one embodiment, the first and the at least one second opening devices comprise tearing devices adapted to be torn off by the user to provide said first and at least one second openings. In one embodiment the tearing device comprises a perforation. In another embodiment, the first opening device comprises a screw-up closure.

In one embodiment, said first and at least one second tearing devices are positioned side by side at one end of said bag with the first perforation being positioned adjacent to a corner of the bag such that said first opening extends from the one end and an adjoining side of the bag and defines a gaseous substance opening, and where said at least one second opening is an enlargement of the first opening and defines a snack product opening. A simple and user friendly solution is thus provided for allowing the user to e.g. inhale the first substance where the first opening may be such that it is adapted to the user's mouth, and where the second opening may be adapted to facilitate the user to access the second substance, e.g. said snack.

However, this disclosure is not limited to such an arrangement. For example, the first tearing device may be placed on one side of the top of the bag, while the second tearing device may be placed at the other side of the top of the bag, at the opposite corner.

In one embodiment, the access to the first substance and the at least one second substances is performed in a specified order, i.e. as already addressed, this may preferably such that first the first substance is accessed, and subsequently said second substance. Said substances may however in one embodiment also be accessed in an unspecified order.

In one embodiment, said opening devices are selected from one or more of the following: a perforation device, a screw up closure, tear notch, perforation, connecting flaps adhered together with an easily separable adhesive, or a plastic ZIPLOC® connector, or another zipper-like or snap-shut opening and closing device. Such an adhesive, ZIPLOC®, or other plastic zipper-like or snap-shut opening and closing device provides the added benefit of allowing the user to partake in some of the first substance or second substance, without having to use all of the first substance or second substance. For example, if the first opening device is a zipper-like opening and closing device, the user is thus permitted to inhale part of the first substance, for example, *cannabis* smoke, while leaving a remainder of *cannabis* smoke within the bag to be inhaled at a later time.

In one embodiment, said first opening device comprises a closing function for allowing closing the first opening.

In one embodiment, said second opening device comprises a closing function for allowing closing the second opening.

Such a closing function is well known to a person skilled in the art and may e.g. comprise any type of adhesion means and the like. The user does therefore not need to finish the first and/or the at least one second substance at once, but instead can close first and/or the second opening again.

In a second aspect of the disclosure, a method is provided of manufacturing an airtight bag for preserving a first substance and at least one second substance, comprising:

providing a bag being open at one end, inserting a first substance and a second substance into the bag via said open end, and sealing the bag such that the bag becomes an airtight bag, where the airtight bag is designed such that a first opening device is provided for providing a first opening and an access by a user to the first substance in the bag, and at least one second opening device is provided for, subsequent to accessing the first substance via said first opening, providing at least one second opening and an access by the user to the at least one second substance in the bag, wherein the first opening device is positioned such that first opening facilitates the access by the user to the first substance, and where the at least one second opening device is positioned such that the at least one second opening facilitates the access by the user to the at least one second substance.

In one embodiment, the method further comprises a step of generating said first and at least one opening devices subsequent to said sealing, where said step may in one embodiment comprise generating a first and at least one second perforations configured to be torn off by a user. As already addressed, the first substances comprises a gaseous substance, which may be comprise, but is not limited to, a *cannabis* smoke, and where the at least one second substance comprises a snack product.

In general the various aspects of the disclosure may be combined and coupled in any way possible within the scope of the disclosure. These and other aspects, features and/or advantages of the disclosure will be apparent from and elucidated with reference to the embodiments described hereinafter.

BRIEF DESCRIPTION OF THE DRAWINGS

Embodiments of the disclosure will be described, by way of example only, with reference to the drawings, in which FIGS. 1(*a*) and 1(*b*) show a first embodiment of an airtight bag for preserving a first substance and at least a second substance.

FIGS. 3(*c*) and 3(*d*) show a method of use of the airtight bag show by FIGS. 3(*a*) and 3(*b*).

FIGS. 4(*c*), 4(*d*), 4(*e*), and 4(*f*) show a method of use of the airtight bag show by FIGS. 4(*a*) and 4(*b*).

DESCRIPTION OF EMBODIMENTS

Figure 1A:
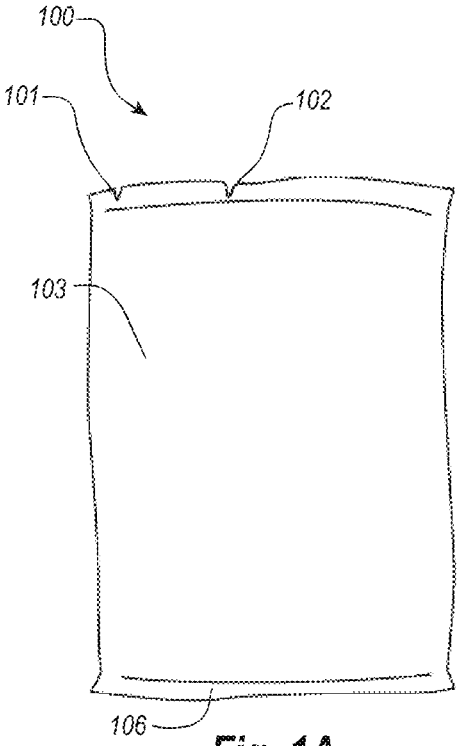
FIGS. 1(*c*) and 1(*d*) show a method of use of the airtight bag show by FIGS. 1(*a*) and 1(*b*).
Figure 1B:
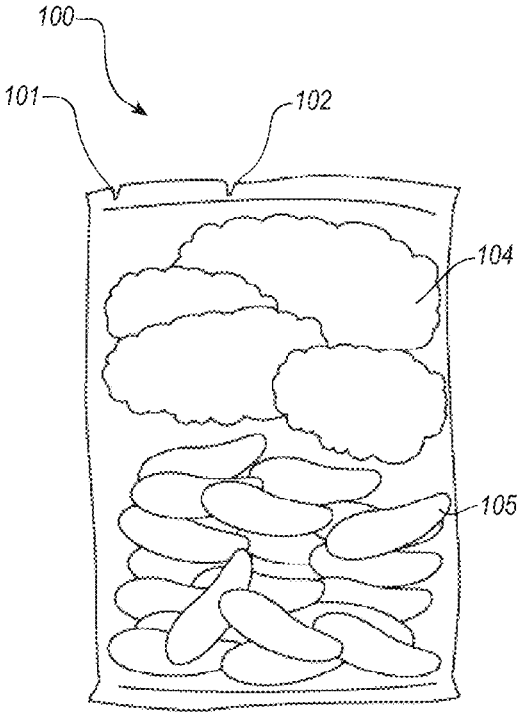
Figure 1C:
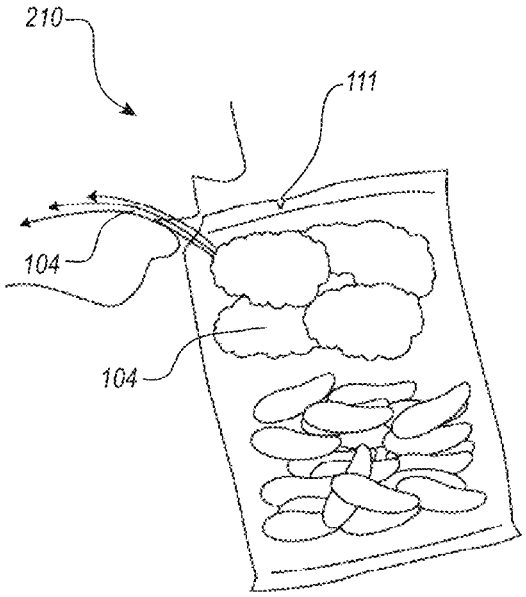
Figure 1D:
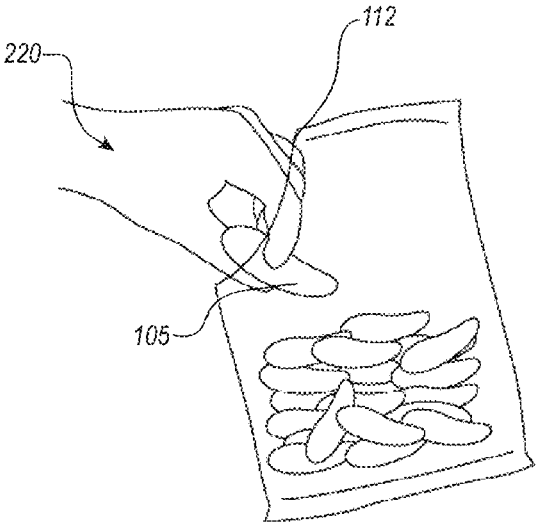

FIGS. 1(*a*) and 1(*b*) show an embodiment of an airtight bag 100 according to the present disclosure for preserving a first substance and at least one second substance.

FIG. 1(*a*) depicts an outer view of the bag 100, and FIG. 1(*b*) depicts an inner view of the bag showing an example of the first substance 104. In this embodiment, the bag contains a first substance 104, which may include one or more gaseous substances, which may include *cannabis* smoke, and the second substance which is as shown is a snack 105 or any other type of dry food. It should be noted that the first and the at least one second substances should not be construed as being limited to said substances, such as *cannabis* smoke, but they could have any type of gaseous substances, fluid substances, medical substances etc. For simplicity, in a first embodiment, the first substance is a gaseous substance, which could be a *cannabis* smoke, and the second substance is chips or the like.

In another embodiment, the first substance includes metabolizable components of *cannabis* smoke provided in a high-nitrogen gas. Such a combination would provide the desired effects of the *cannabis* smoke, while the high-nitrogen content of the gas would reduce oxidation of the second substance, for example, oxidation of the oils of the potato chips which may produce a funny or "off" flavor.

In another embodiment, the first substance is a gaseous substance that includes a medication.

In another embodiment, the first substance is a gaseous substance that includes a medication to be consumed by the user.

In another embodiment, the first substance is a gaseous substance that includes an appetite including aroma. In yet another embodiment, the first substance is an appetite including medication. In yet another embodiment, the first substance is a medicated mist. The first substance may also include tobacco smoke, peyote smoke, or synthetic smokes or synthetic cannabinoids. The first substance, according to another embodiment, may include smoke of *salvia* divinorum. In another embodiment, the first substance is mist having particles sizes larger than those in ordinary smoke. For example, the first substance may include an aromatic mist. In another embodiment, the first substance is a gaseous substance that includes tetrahydrocannabinol (THC), in either a mist form or a smoke form. In another embodiment, the first substance is a gaseous substance that includes an herbal incense or an herbal smoking blend. In yet another embodiment, the first substance is a gaseous substance that includes other cannabinoid in a mist form, such as cannabidiol, cannabinol, cannabigerol, tetrahydrocannabivarin, or other cannabinoids, either natural or synthetically produced. Alternatively, the first substance may be any of the above components in an aerosol form, or in a solvent form, in any other inhalant type form.

As shown in FIGS. 1(*a*) and 1(*b*), the airtight bag 100 according to an embodiment includes a first opening device 101 for providing a first opening 111 and an access for a user to the first substance 104 in the bag. The second opening device 102 provides a second opening 112, which may be utilized subsequent to accessing the first substance via said first opening, and an access for the user to the at least one second substance 105 in the bag. As depicted in this embodiment, the first and the second openings are positioned at one side of the bag 100, where the opposite side is a closed bottom side 106, where a bag body 103 extends there between defining the volume of the bag. The geometry of the bag should not be construed to the one shown here, but the geometry of the bag could e.g. just as well be triangular, pentagon etc.

The first and the second opening devices 101, 102 shown here comprise tearing devices, e.g. perforations and the like, positioned side by side at one end of said bag.

Figure 2A:
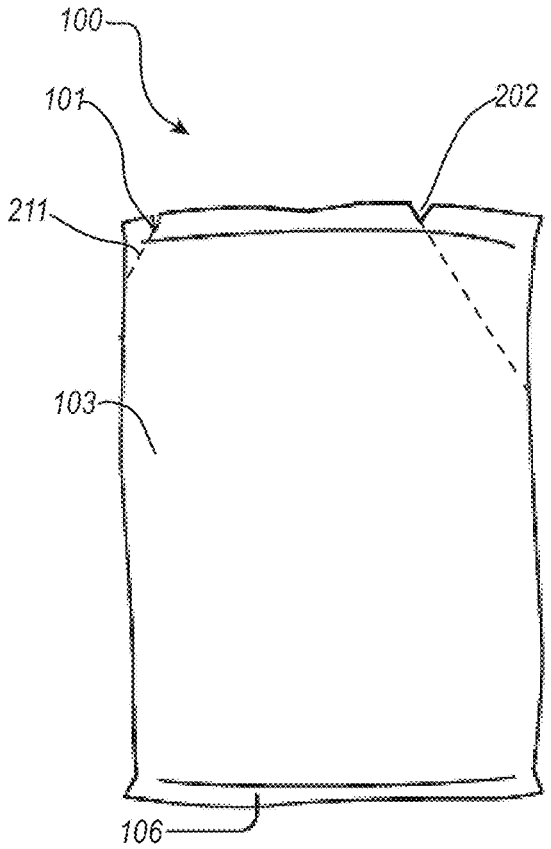
FIGS. 2(*a*) and 2(*b*) show another embodiment of an airtight bag for preserving a first substance and at least a second substance.
Figure 2B:
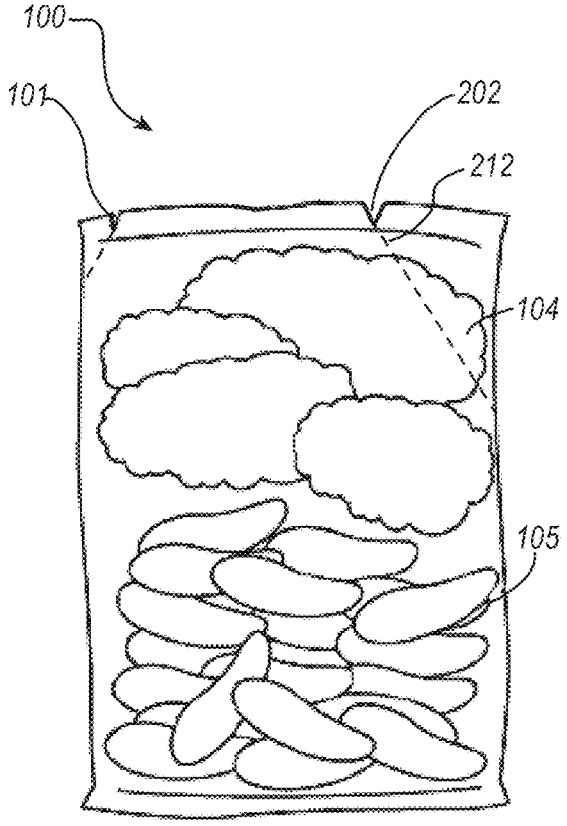
Figure 3A:
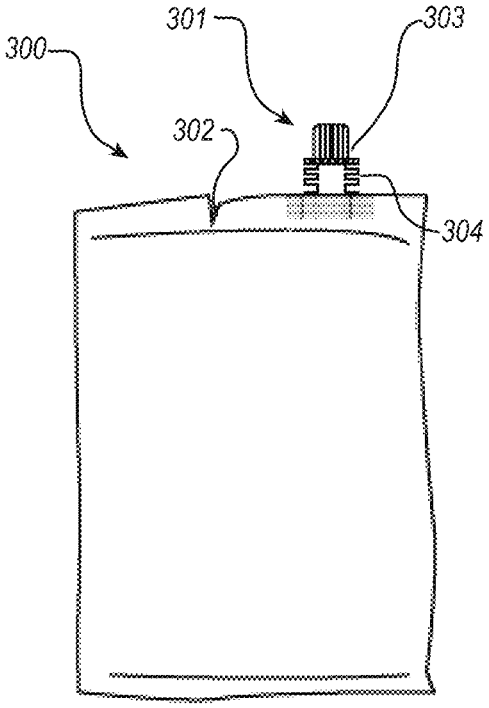
FIGS. 3(*a*) and 3(*b*) show another embodiment of an airtight bag for preserving a first substance and at least a second substance.
Figure 3B:
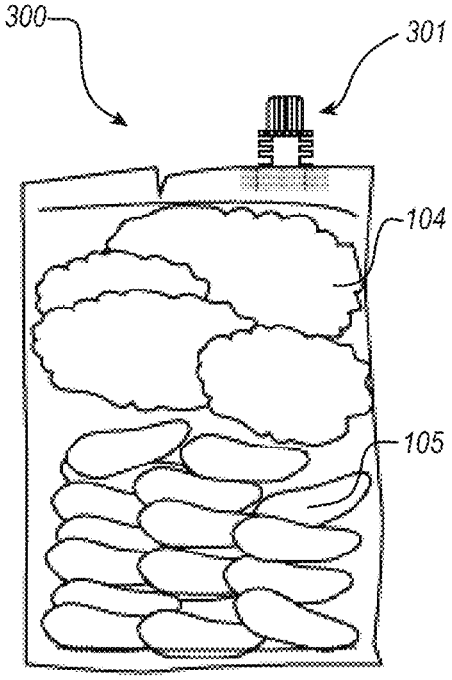
Figure 3C:
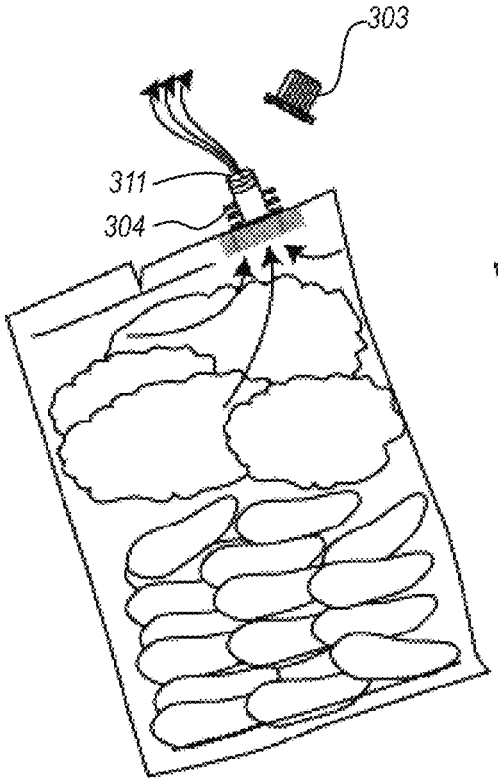
Figure 3D:
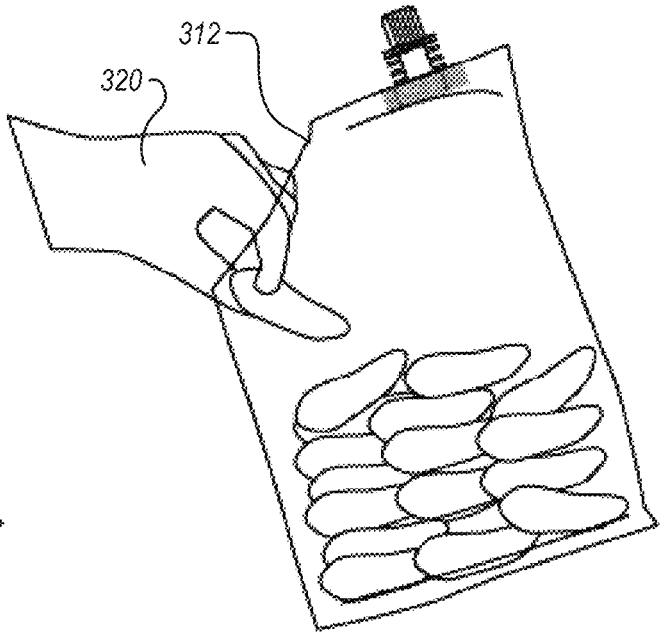
Figure 4A:
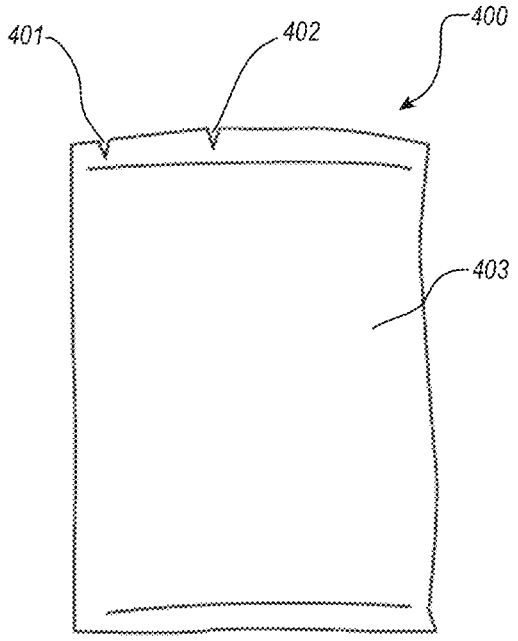
FIGS. 4(*a*) and 4(*b*) show another embodiment of an airtight bag for preserving a first substance and at least a second substance.
Figure 4B:
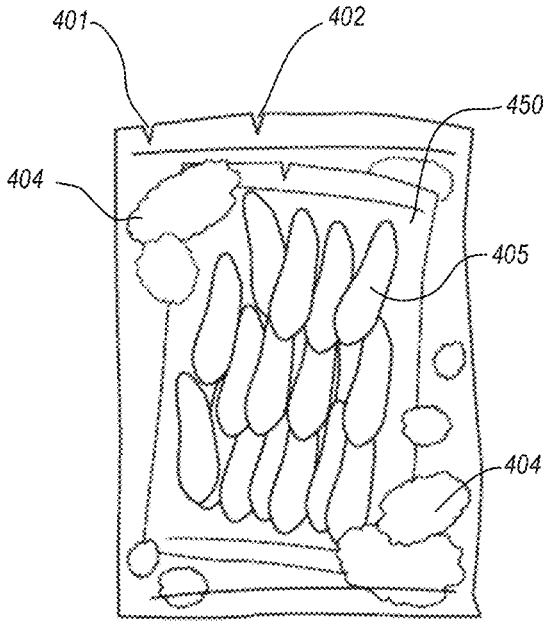
Figure 4C:
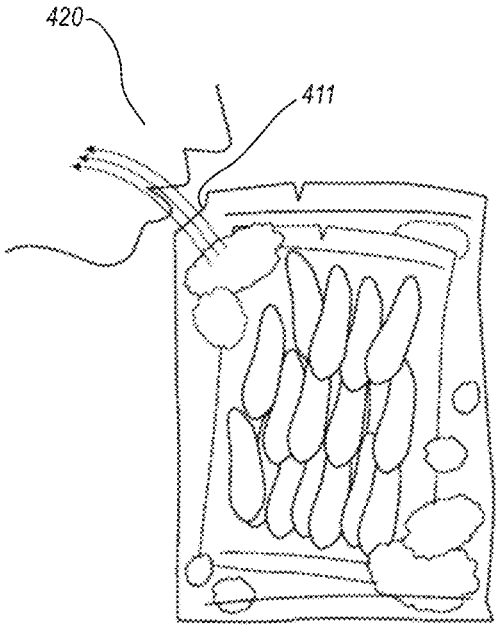
Figure 4D:
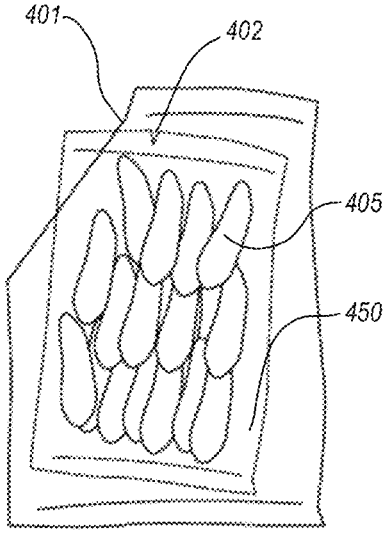
Figure 4E:
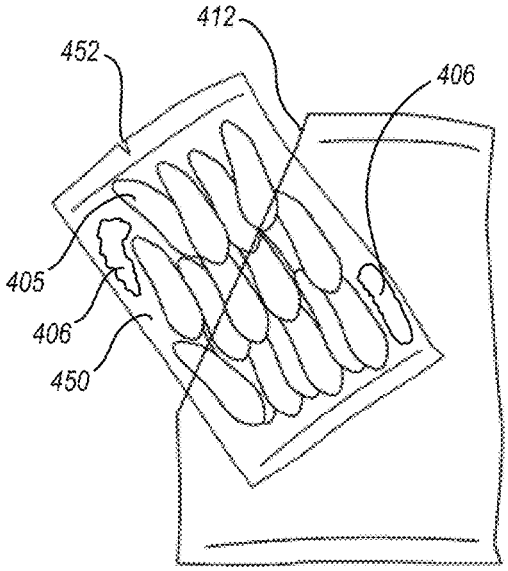
Figure 4F:
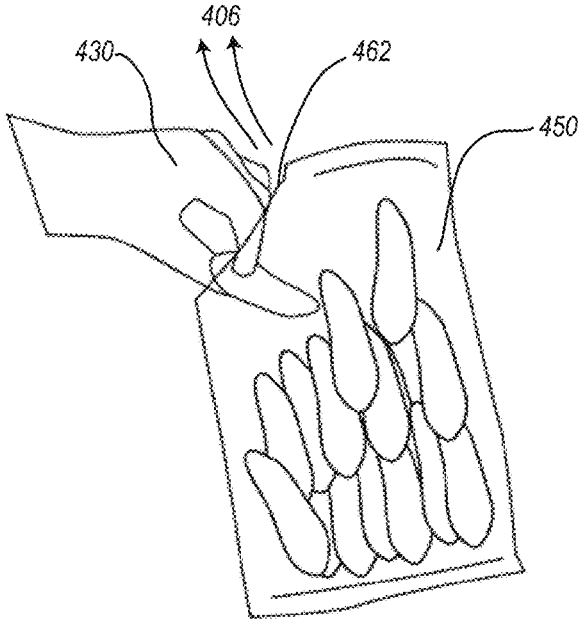

In another embodiment, as shown in FIGS. 2(*a*) and 2(*b*), which show an outer and inner view of the bag 100 according to another embodiment. According to the embodiment of FIGS. 2(*a*) and 2(*b*), the first opening device 101 is provide in a first corner of the bag 100, while opening device 202 is provided in a different corner of bag 100. Thus, first opening device provides a first opening 211 in the first opening 211 (shown by the dotted line in FIGS. 2(*a*) and 2(*b*), while the second opening device 202 provides a second opening 212 formed in a different corner.

FIGS. 1(*c*) and 1(*d*) show an implementation of the bag in FIGS. 1(*a*) and 1(*b*), where FIG. 1(*c*) shows where the bag provides for a user 210 to tear bag at the first perforation 101 leaving a first opening 111 extending from the one end side and an adjoining side of the bag and defines a "gaseous substance opening", which fits to the users mouth and thus facilitates the inhaling of the first gaseous substance 104.

In an embodiment not shown here, the first opening device may be designed such that the user 210 may at all time close it back, such as a ZIPLOC® connector, where an appropriate sealing mechanism, e.g. adhesion on the inner side, may be provided, for allowing the user to close the first opening. In that way the bag does not require the user to finish the first substance immediately.

FIG. 1(*d*) shows the bag providing the user 210, after inhaling the gaseous substance 104, a second perforation 102 to provide a second opening 112 which is larger than said first opening 111, which has a size that fits to the users hand 220, and that allows user in a user-friendly manner to access said second substance, i.e. the chips 105 as shown here. Although chips are shown in the figure, the second substance may include a wide variety of consumable products, such as food products, liquid products, or slurry-based products. For example, the second substance may include cookies, crackers, popcorn, crisps, candy, bread products, pastries, or dried meats, such as jerky. As discussed above, the second substance may, in another embodiment, include a liquid substance, such as water, fruit juice, vegetable juice, milk or other dairy products, or soda pop. Alternatively, the second substance may include consumable slurry, such as a protein shake, milkshake, or a smoothie-type substance.

FIGS. 3(*a*) and 3(*b*) show another embodiment of an airtight bag 300, where the first opening device includes screw-type closure 301 including a cap 303 and a threaded base 304. The second opening device comprises a perforation 302 which is more or less identical to the second perforation as shown in FIGS. 1(*a*) and 1(*b*).

As shown in FIGS. 3(*c*) and 3(*d*), by unscrewing the capsule of the screw-type closure 301 the user (not shown here), the bag 300 provides the user access to the first substance 104 via a first opening 311, which, as already addressed, may e.g. be any type of gaseous substance adapted to be inhaled by the user via the first opening that is created by unscrewing the capsule. The user can of course screw the cap 303 back to the threaded base 304 of the screw up closure 301. After inhaling the gaseous substance 104 (the first substance) the user can tear of the perforation 302 to access the second substance, e.g. the chips as shown here.

In another embodiment, in the outer view of FIG. 4(*a*) and the inner view of FIG. 4(*b*), a bag system 400 is shown. According to the embodiment of FIGS. 4(*a*) and 4(*b*), a first opening device 401 for providing a first opening 411 and an access for a user 420 to the first substance 404 in the bag. A second opening device 402 provides a second opening 412, which may be utilized subsequent to accessing the first substance via said first opening, and an access by the user 420 to a second bag 450, which is provided within the first bag 403. And a second substance 405 is contained within the second bag 450. Second bag 450 is provided with a third opening device 452, which, when utilized, provides access by tearing, for example, to the second substance 405 through third opening 462. As depicted in FIGS. 4(*a*) and 4(*b*), the first and the second openings are positioned at one side of the bag 100, where the opposite side is a closed bottom side, where a first bag body 403 extends there between defining the volume of the bag. The geometry of the bag should not be construed to the one shown here, but the geometry of the bag could e.g. just as well be triangular, pentagon etc.

According to this embodiment, the user may inhale the first substance 404, and then is provided access through the second opening 412 to remove the second bag 450. The second bag 450 may be opened through the third opening device 452 to provide third opening 462. According to this example, the second substance 405 is protected by both a first substance 404 contained within the first bag body 403 and also by a third substance 406 contained only within the second bag 450. The first substance may include, for example, *cannabis* smoke, while the third substance 406 includes a high-nitrogen content gas. According to this example, the second substance 405, which may include, for example, potato chips, may be contained in such a way that the second substance is not infused with the taste or aroma of the first substance 404. For example, the potato chips are not infused with the smell or taste of the *cannabis* smoke, but can be regular-tasting potato chips or any other type of food product or liquid or slurry. And the high-nitrogen content of the third substance 406 will maintain the "freshness" of the second substance 405 by reducing overall oxidation of the second substance 405.

Further, although not shown, the first opening device of a system similar to that of FIGS. 4(*a*) to 4(*f*), the first opening device may be provided, similar to that shown in FIGS. 2(*a*) and 2(*b*), is provide in a first corner of a first bag body, while the second opening device is provided in a different corner of the first bag body. Thus, the first opening device provides a first opening in a first corner while the second opening device provides an second opening in a second corner, which is different from the first corner.

Similar to that of FIGS. 1(*c*) and 1(*d*), the system 400 of FIGS. 4(*a*) to 4(*d*) show an implementation of the first bag system, where FIG. 4(*c*) shows where the bag provides for a user 420 to tear the first bag at the first perforation 401 leaving a first opening 411 extending from the one end side and an adjoining side of the bag and defines a "gaseous substance opening", which fits to the users mouth and thus facilitates the inhaling of the first gaseous substance 404.

In an embodiment not shown here, the first opening device may be designed such that the user 420 may close it back, such as a ZIPLOC® connector, where an appropriate sealing mechanism, e.g. adhesion on the inner side, may be provided, for allowing the user to close the first opening. In that way the bag does not require the user to finish the first substance immediately.

FIG. 4(*d*) shows the bag providing the user 420, after inhaling the gaseous substance 404, a second perforation 402 to provide a second opening 412 which is larger than said first opening 411, which has a size that accommodates retrieval of a second bag 450. And the second bag 450 includes third opening device 452, which provides third opening 462, that allows user 420 in a user-friendly manner to access said second substance 405, i.e. the chips as shown here.

Figure 5:
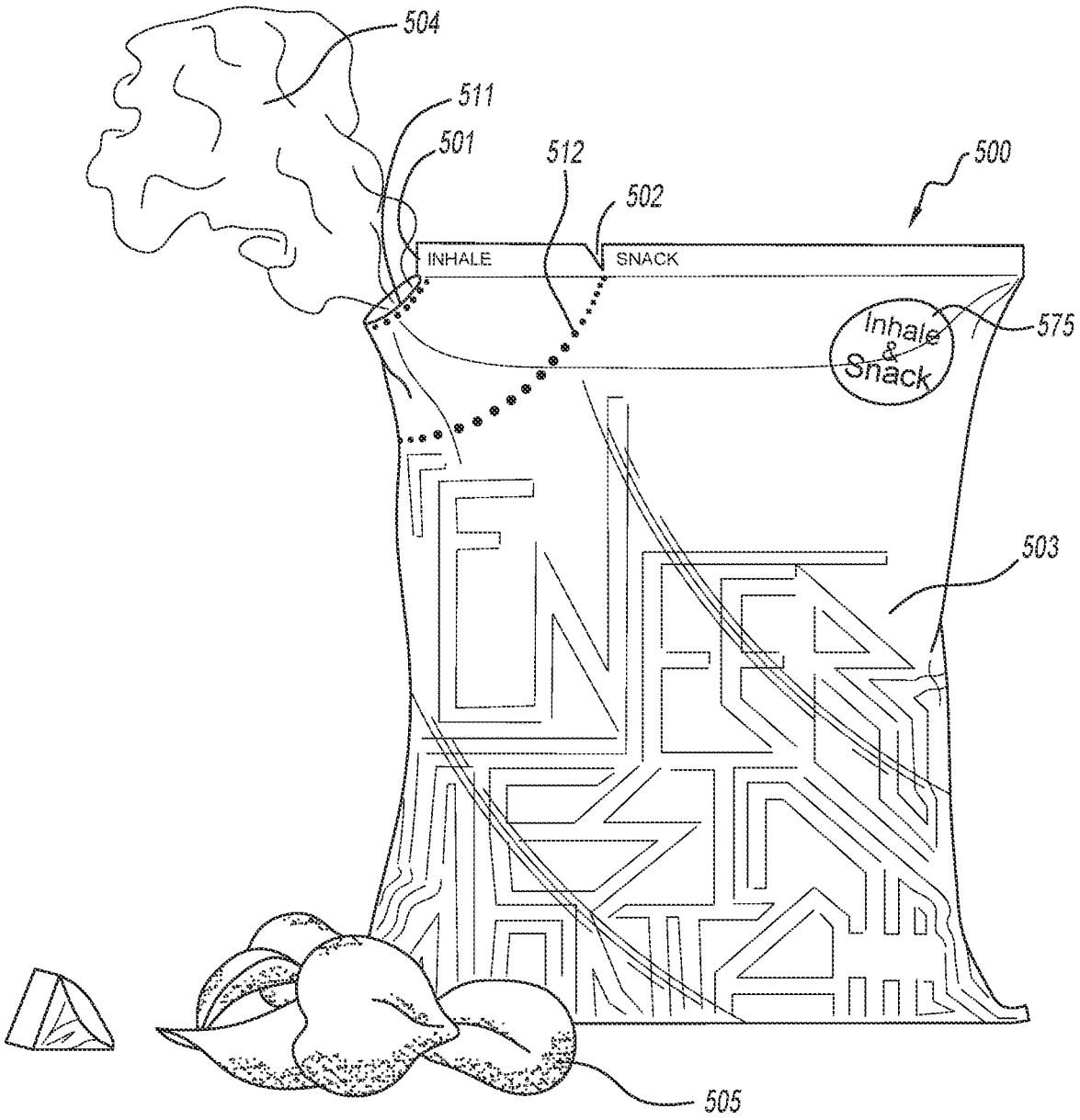
FIG. 5 show another embodiment of an airtight bag for preserving a first substance and at least a second substance.

FIG. 5 shows a bag 500 according to another embodiment, which, similar to the embodiment of FIGS. 1(*a*) to 1(*d*), includes first opening device 501 to allow first opening 511 to be easily made. A user may then inhale the first substance 504. Subsequently (although not necessarily subsequently), second opening device 502 may provide a second opening at 512, which would allow user-friendly access to the second substance, which may include potato chips 505. The outer surface 503 of the bag 500 may have an advertisement or label 575 provided therein.

In the above examples, the bag may be made of a plastic, metal foil, or laminate material. For example, the bag material may be of a metalized polypropylene material. For example, the bag material may be a plastic-type material covered with a thin aluminum film. Or the bag may simply include a polypropylene material, oriented polyproplylene (such as biaxially oriented polypropylene (BOPP), or a low-density polyethylene film. Alternatively, the bag material may be made of multiple layers of polymer materials, such as biaxially oriented polypropylene (BOPP) on the inside, a low-density polyethylene (LDPE) as a middle layer, another middle layer of BOPP, and an outer layer of a thermoplastic resin, such as Surlyn®. Or alternatively, the bag material may consist of metal films, such as aluminum or tin foil. Or, the bag material may be composed of a laminate material of one or more plastic layers and one or more metal films. Alternatively, the bag material may include a rubber or polymer-based material.

In another embodiment, the inner lining of the bag is coated with a chemical material that reduces condensation of the metabolizable components of the first substance. For example, the inner layer of the bag material may have a surfactant provided thereon that reduces condensation of THC or other cannabinoids on the inner surface of the bag material and maintain the metabolizable components of the first substance, for example, *cannabis* smoke, in a gaseous state within the bag material.

Based on the above disclosure, the following configurations of embodiments are provided.

1. An airtight bag for preserving a first substance and at least one second substance, the bag comprising:
   - a first opening device that provides a first opening and an access to a user to the first substance in the bag;
   - at least one second opening device for, subsequent to accessing the first substance via said first opening, providing at least one second opening and an access to the user to the at least one second substance in the bag;
   - wherein the first opening device is arranged such that first opening facilitates the access to the user to the first substance, and wherein the at least one second opening device is arranged such that the at least one second opening facilitates the access to the user to the at least one second substance.

2. The airtight bag according to 1 above and/or 3-13 below, wherein the first substance comprises a gaseous substance adapted to be inhaled by the user via said first opening.

3. The airtight bag according to 1 and/or 2 above and/or 4-13 below, wherein the gaseous substance comprises a *cannabis* smoke.

4. The airtight bag according to 1-3 above and/or 5-13 below, wherein the at least one second substance comprises a snack product and where the at least one second opening is larger that said first opening.

5. The airtight bag according to 1-4 above and/or 6-13 below, wherein the first and the at least one second opening devices comprise tearing devices adapted to be teared off by the user for providing said first and at least one second openings.

6. The airtight bag according to 1-5 above and/or 7-13 below, wherein the tearing devices comprise a perforation.

7. The airtight bag according to 1-6 above and/or 8-13 below, wherein the first opening device comprises a screw-up closure.

8. The airtight bag according to 1-7 above and/or 9-13 below, wherein said first and at least one second tearing devices are positioned side by side at one end of said bag with the first perforation being positioned adjacent to a corner of the bag such that said first opening extends from the one end and an adjoining side of the bag and defines a gaseous substance opening, and where said at least one second opening is an enlargement of the first opening and defines and snack product opening.

9. The airtight bag according to 1-8 above and/or 10-13 below, wherein the bag comprises a bag and where said first substance and at least one second substances are preserved in the bag.

10. The airtight bag according to 1-9 above and/or 11-13 below, wherein the access to the first substance and the at least one second substances is performed in a specified order.

11. The airtight bag according to 1-10 above and/or 12-13 below, wherein the access to the first substance and the at least one second substances is performed in an unspecified order.

12. The airtight bag according to 1-11 above and/or 13 below, wherein said opening devices include one or more of the following:

a perforation device, a screw up closure, tear notch, or perforation.

13. The airtight bag according to 1-12 above, wherein the first and the at least one second substances include one or more of the following:

a food product, a liquid, a medical product.

14. A method of manufacturing an airtight bag for preserving a first substance and at least one second substance, comprising:

providing a bag being open at one end, inserting a first substance and a second substance into the bag via said open end, and sealing the bag such that the bag becomes an airtight bag, where the airtight bag is designed such that a first opening device is provided for providing a first opening and an access to a user to the first substance in the bag, and at least one second opening device is provided for, subsequent to accessing the first substance via said first opening, providing at least one second opening and an access by the user to the at least one second substance in the bag, wherein the first opening device is positioned such that first opening facilitates the access to the user to the first substance, and where the at least one second opening device is positioned such that the at least one second opening facilitates the access by the user to the at least one second substance.

15. The method according to 14 above and/or 16-19 below, further comprising a step of generating said first and at least one opening devices subsequent to said sealing.

16. The method according to 14 and/or 15 above and/or 17-19 below, wherein said step of generating said first and at least one opening devices comprises generating a first and at least one second perforations configured to be torn off by a user.

17. The method according to 14-16 above and/or 18-19 below, wherein the first substance comprises a gaseous substance.

18. The method according to 14-17 above and/or 19 below, wherein the gaseous substance comprises a *cannabis* smoke.

19. The method according to 14-18 above, wherein the at least one second substance comprises a snack product.

20. An airtight bag system for preserving a first substance and at least one second substance, the system comprising:

a first opening device that provides a first opening and an access to a user to the first substance in a first bag;

at least one second opening device for, subsequent to accessing the first substance via said first opening, providing at least one second opening and an access to the user to a second bag, the second bag being contained at least partially within the first bag, the at least one second substance being contained within the second bag;

a third opening device for providing a third opening to the second bag;

wherein the first opening device is arranged such that first opening facilitates the access to the user to the first substance, and wherein the at least one second opening device is arranged such that the at least one second opening facilitates the access to the user to the second bag, and the third opening provides access to the user to the at least one second substance.

21. The airtight bag system according to 20 above and/or 22-32 below, wherein the first substance comprises a gaseous substance adapted to be inhaled by the user via said first opening.

22. The airtight bag system according to 20 and/or 21 above and/or 23-32 below, wherein the gaseous substance comprises a *cannabis* smoke.

23. The airtight bag system according to 20-22 above and/or 24-32 below, wherein the at least one second substance comprises a snack product and where the at least one second opening is larger that said first opening.

24. The airtight bag system according to 20-23 above and/or 25-32 below, wherein the first and the at least one second opening devices comprise tearing devices adapted to be teared off by the user for providing said first and at least one second openings.

25. The airtight bag system according to 20-24 above and/or 26-32 below, wherein the tearing devices comprise a perforation.

26. The airtight bag system according to 20-25 above and/or 27-32 below, wherein the first opening device comprises a screw-up closure.

27. The airtight bag according to 20-26 above and/or 28-32 below, wherein said first and at least one second tearing devices are positioned side by side at one end of said bag with the first perforation being positioned adjacent to a corner of the bag such that said first opening extends from the one end and an adjoining side of the bag and defines a gaseous substance opening, and where said at least one second opening is an enlargement of the first opening and defines and snack product opening.

28. The airtight bag system according to 20-27 above and/or 29-32 below, wherein the bag system comprises a first bag and where said first substance is preserved in the first bag and at least one second substances are preserved in the second bag.

29. The airtight bag system according to 20-28 above and/or 29-32 below, wherein the access to the first substance and the at least one second substances is performed in a specified order.

30. The airtight bag system according to 20-29 above and/or 31-32 below, wherein the access to the first substance and the at least one second substances is performed in an unspecified order.

31. The airtight bag system according to 20-30 above and/or 32 below, wherein said opening devices include one or more of the following:

a perforation device, a screw up closure, a tear notch, or a perforation.

32. The airtight bag system according to 20-31 above, wherein the first and the at least one second substances include one or more of the following:

a food product, a liquid, or a medical product.

While the disclosure has been illustrated and described in detail in the drawings and foregoing description, such illustration and description are to be considered illustrative or exemplary and not restrictive; the disclosure is not limited to the disclosed embodiments. Other variations to the disclosed embodiments can be understood and effected by those skilled in the art in practicing the claimed disclosure, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage.

The invention claimed is:

1. An airtight bag for preserving a first substance and at least one second substance, the bag comprising:

a first opening device that provides a first opening and an access to a user to the first substance in the bag;

at least one second opening device for, subsequent to accessing the first substance via said first opening, providing at least one second opening and an access to the user to the at least one second substance in the bag;

wherein the first opening device is arranged such that first opening facilitates the access to the user to the first substance, and wherein the at least one second opening device is arranged such that the at least one second opening facilitates the access to the user to the at least one second substance, wherein the first substance comprises a gaseous substance adapted to be inhaled by the user via said first opening, and wherein the gaseous substance comprises a *cannabis* smoke.

2. The airtight bag according to claim 1, wherein the at least one second substance comprises a snack product and wherein the at least one second opening is larger that said first opening.

3. The airtight bag according to claim 1, wherein the first and the at least one second opening devices comprise tearing devices adapted to be teared off by the user for providing said first and at least one second openings.

4. The airtight bag according to claim 3, wherein the tearing devices comprise a perforation.

5. The airtight bag according to claim 3, wherein said first and at least one second tearing devices are positioned side by side at one end of said bag with a first perforation being positioned adjacent to a corner of the bag such that said first opening extends from the one end and an adjoining side of the bag and defines a gaseous substance opening, and wherein said at least one second opening is an enlargement of the first opening and defines and snack product opening.

6. The airtight bag according to claim 1, wherein the first opening device comprises a screw-up closure.

7. The airtight bag according to claim 1, wherein the bag comprises a bag and wherein said first substance and at least one second substances are preserved in the bag.

8. The airtight bag according to claim 1, wherein the access to the first substance and the at least one second substances is performed in a specified order.

9. The airtight bag according to claim 1, wherein the access to the first substance and the at least one second substances is performed in an unspecified order.

10. The airtight bag according to claim 1, wherein said opening devices include one or more of the following:

a perforation device, a screw up closure, tear notch, or perforation.

11. The airtight bag according to claim 1, wherein the first and the at least one second substances include one or more of the following:

a food product, a liquid, or a medical product.

12. A method of manufacturing the airtight bag according to claim 1, the method comprising:

providing a bag that is open at an open end, inserting a first substance and a second substance into the bag via said open end, and sealing the bag such that the bag becomes an airtight bag, wherein the airtight bag is designed such that a first opening device is provided for providing a first opening and an access to a user to the first substance in the bag, and at least one second opening device is provided for, subsequent to accessing the first substance via said first opening, providing at least one second opening and an access by the user to the at least one second substance in the bag, wherein the first opening device is positioned such that first opening facilitates the access to the user to the first substance, wherein the at least one second opening device is positioned such that the at least one second opening facilitates the access by the user to the at least one second substance, wherein the first substance comprises a gaseous substance adapted to be inhaled by the user via said first opening, and wherein the gaseous substance comprises a *cannabis* smoke.

13. The method according to claim 12, further comprising a step of generating said first and at least one opening devices subsequent to said sealing.

14. The method according to claim 13, wherein said step of generating said first and at least one opening devices comprises generating a first and at least one second perforations configured to be torn off by a user.

15. The method according to claim 12, wherein the first substances comprises a gaseous substance.

16. The method according to claim 15, wherein the gaseous substance comprises a *cannabis* smoke.

17. The method according to claim 12, wherein the at least one second substance comprises a snack product.

18. An airtight bag system for preserving a first substance and at least one second substance, the system comprising:

a first opening device that provides a first opening and an access to a user to the first substance in a first bag;

at least one second opening device for, subsequent to accessing the first substance via said first opening, providing at least one second opening and an access to the user to a second bag, the second bag being contained at least partially within the first bag, the at least one second substance being contained within the second bag;

a third opening device for providing a third opening to the second bag;

wherein the first opening device is arranged such that first opening facilitates the access to the user to the first substance, and wherein the at least one second opening device is arranged such that the at least one second opening facilitates the access to the user to the second bag, and the third opening provides access to the user to the at least one second substance, wherein the first substance comprises a gaseous substance adapted to be inhaled by the user via said first opening, and wherein the gaseous substance comprises a *cannabis* smoke.

* * * * *